US005145249A

United States Patent [19]

Bruckner

[11] Patent Number: 5,145,249

[45] Date of Patent: Sep. 8, 1992

[54] VARIABLE-POSITION RECESSED LIGHT FIXTURE

[75] Inventor: Attila A. Bruckner, Ratingen, Fed. Rep. of Germany

[73] Assignee: Ansorg Lichttechnik Gesellschaft Mit Beschrankter Haftung, Mulheim/Ruhr, Fed. Rep. of Germany

[21] Appl. No.: 791,657

[22] Filed: Nov. 8, 1991

[30] Foreign Application Priority Data

Nov. 14, 1990 [DE] Fed. Rep. of Germany ..... 4036229

[51] Int. Cl.[5] ..... F21S 1/06

[52] U.S. Cl. ..... 362/365; 362/364; 362/427

[58] Field of Search ..... 362/364, 365, 287, 427

[56] References Cited

U.S. PATENT DOCUMENTS 4,232,361 11/1980 Kelsall ..... 362/364
4,851,970 7/1989 Bronder ..... 362/427 X
4,881,157 11/1989 Pahl ..... 362/364 X
5,081,566 1/1992 Crispin et al. ..... 362/804 X

*Primary Examiner*—Allen M. Ostrager
*Attorney, Agent, or Firm*—Herbert Dubno; Andrew Wilford

[57] ABSTRACT

A recessed light fixture has an outer housing adapted to be fixedly mounted in a hole in a wall or ceiling and centered on an axis, an inner lamp holder provided with a socket for a light bulb and centered on an axis, and a pair of stiff links of different lengths each having an inner end pivoted on the housing and an outer end pivoted on the holder for movement of the holder between an inner position recessed in the housing with the holder and housing axes generally coaxial and an outer position outside the housing with the axis inclined to each other and through intermediate positions such that as the holder moves outward the angle its axis forms with the housing axis increases and as it moves inward the angle its axis forms with the housing axis decreases. Each intermediate position corresponds to a particular angular orientation of the holder axis to the housing axis, that is the inward/outward movement and pivoting movement are dependent on each other so that each angular position corresponds to one and only one in-to-out position.

9 Claims, 2 Drawing Sheets

VARIABLE-POSITION RECESSED LIGHT FIXTURE

FIELD OF THE INVENTION

The present invention relates to a recessed light fixture. More particularly this invention concerns such a light fixture where the position of the lamp can be adjusted.

BACKGROUND OF THE INVENTION

A standard recessed light fixture has a housing that is mounted in a hole in a wall or ceiling and that is provided internally with a lamp holder that incorporates a socket for the bulb. In many systems the lamp holder itself is somewhat movable inside the housing so that the lamp can be directed differently, depending on application.

In U.S. Pat. No. 3,974,371 of E. Miles such a light fixture is shown where the lamp holder is mounted on two identical pairs of rigid links so that it can moved inward and outward in the housing and also tipped about an axis crossing the inward/outward adjustment direction. This provides a great deal of flexibility but has the considerable disadvantage that it is possible to tip the lamp holder while it is still recessed in the housing so that the housing edge cuts the lamp beam. In practice it is essential that only when the lamp holder is moved somewhat outward out of the housing should it be tipped, and when it is in its innermost position it should be aligned coaxially with the housing.

In another known arrangement the lamp holder has on its lower portion pivot pins that can rotate in corresponding seats in the housing. When the pins are provided on a plane bisecting the assembly the beam of the lamp is cut by the housing increasingly as it is pivoted out of its coaxial position. On the other hand when the pins are offset from this plane the lamp holder swings out when pivoted, but when swung out there is less friction to hold it at the pivots and a considerable space is created on the back side of the holder.

OBJECTS OF THE INVENTION

It is therefore an object of the present invention to provide an improved recessed light fixture.

Another object is the provision of such an improved recessed light fixture which overcomes the above-given disadvantages, that is whose beam angle can be adjusted easily but without the problems attendant to the known systems.

SUMMARY OF THE INVENTION

A recessed light fixture according to the invention has an outer housing adapted to be fixedly mounted in a hole in a wall or ceiling and centered on an axis, an inner lamp holder provided with a socket for a light bulb and centered on an axis, and a pair of stiff links of different lengths each having an inner end pivoted on the housing and an outer end pivoted on the holder for movement of the holder between an inner position recessed in the housing with the holder and housing axes generally coaxial and an outer position outside the housing with the axes inclined to each other and through intermediate positions such that as the holder moves outward the angle its axis forms with the housing axis increases and as it moves inward the angle its axis forms with the housing axis decreases. Each intermediate position corresponds to a particular angular orientation of the holder axis to the housing axis, that is the inward/outward movement and pivoting movement are dependent on each other so that each angular position corresponds to one and only one in-to-out position.

Thus with this system as the holder is pulled out it automatically tips, and as it is pushed back up into the housing it automatically aligns itself with the housing. This makes adjusting it extremely easy.

According to further features of the invention the holder and housing are generally symmetrical to a symmetry plane including the axes in the inner position and two such pairs of links symmetrically flank the plane. This makes for an extremely solid mounting of the holder in the housing. Furthermore according to the invention the links are pivoted on the holder at locations spaced apart by a predetermined small distance and on the housing at locations spaced apart by a larger distance. One of the links of each pair is an L-shaped long link and the other link is a short link.

In order to allow the lamp holder also to be swiveled the housing includes a cylindrical outer part centered on the housing axis and a cylindrical inner part pivotal about the housing axis inside the outer part. The links are pivoted on the inner part and one of the parts has an annular groove centered on the axis and the other part has a ridge fitting radially into the groove.

The holder in accordance with the invention is cup-shaped and is provided internally with a reflector. In addition a stop in the housing solidly engages the holder only in the inner position thereof.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
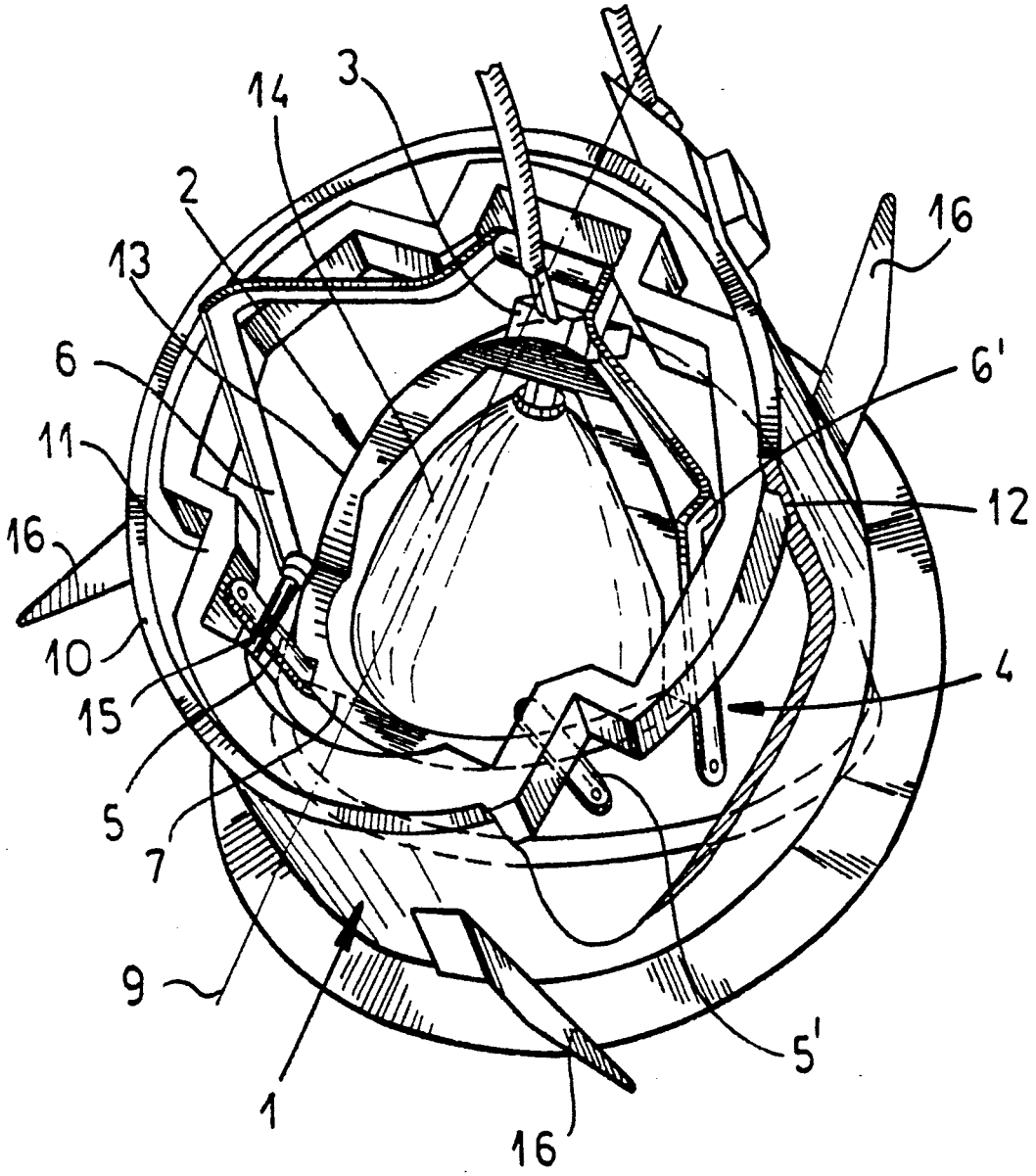
FIG. 1 is a partly sectional perspective view of the light fixture according to the invention.
Figure 2:
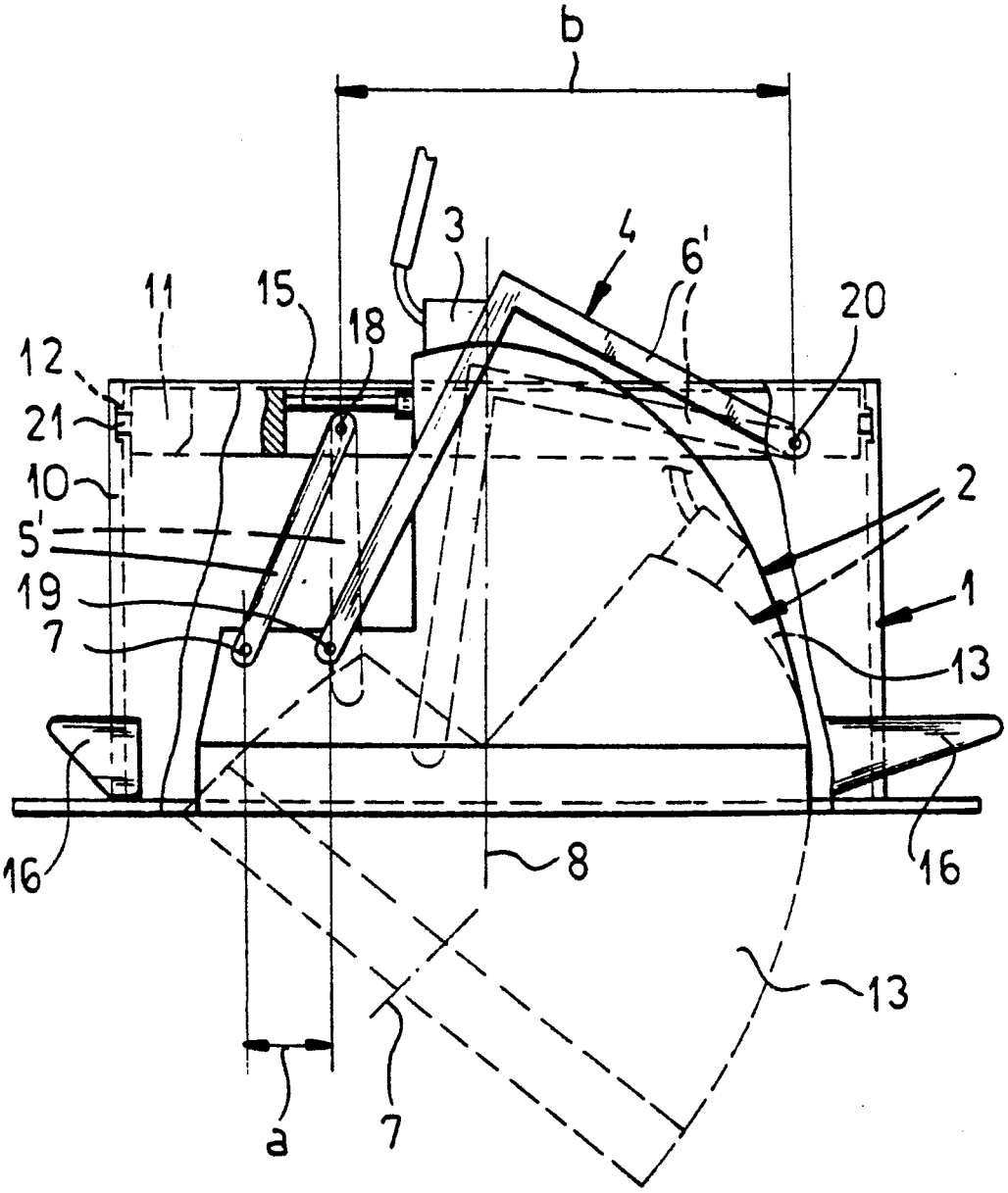
FIG. 2 is a partly sectional side view of the light fixture.

As seen in FIGS. 1 and 2 a recessed light fixture according to the invention basically comprises a housing 1 centered on an axis 8 that normally extends perpendicular to the wall or ceiling in which the fixture is mounted and a lamp holder 2 provided with a socket 3 for a lamp, here a low-voltage halogen one. The holder 2 and socket 3 are themselves centered on an axis 17 that is coaxial with the axis 8 in an inner position of the holder 2 and at an angle thereto in an outer position as shown in dashed lines in FIG. 2.

Two identical linkages 4 carry the holder 2 on the housing 1. These linkages 4 comprise short straight links 5 and 5' and long L-shaped links 6 and 6' and the linkages 4 symmetrically flank a symmetry plane 9 including the axis 8. The short links 5 and 5' have outer ends pivoted coaxially at 7 on the holder 2 and inner ends pivoted coaxially at 18 on the housing 1 while the long links have outer ends pivoted coaxially at 19 on the holder 2 and inner ends pivoted coaxially at 20 on the housing 1, with all of the pivot axes perpendicular to the plane 9. The pivots 7 and 19 are spaced apart by a relatively short distance a and the pivots 18 and 20 are spaced in a parallel direction by a relatively long distance b.

The housing 1 is formed by a cylindrical outer part 10 centered on the axis 8 and formed with a radially inwardly open groove 12 and an inner part 11 carrying the pivots 18 and 20 and formed with a projection 21 engaging in the groove 12. Thus the inner part 11 can rotate about the axis 8 in the outer part through about 360° for full-rotation aiming of the lamp. Bendable tabs 16 on the outer part facilitate securing it in a hole in a wall or ceiling.

The holder 2 itself is formed by a cup 13 provided with the pivots 7 and 19 and carrying the socket 3, and an internal reflector 14 which houses the unillustrated light bulb. A stop screw 15 on the inner housing part 11 engages the holder part 13 in its inner position with the axes 8 and 17 coaxial.

Thus with the system of this invention due to the relative lengths of the links 5, 5' and 6, 6' and the spacings a and b, the lamp axis 17 will move on displacement from the holder 2 between the inner and outer positions between a position perfectly coaxial with the housing axis 8 and a position forming an angle of about 40° therewith. As the holder moves outward it pivots and vice versa, so that each in-to-out position is associated with a respective angular position.

I claim:

1. A recessed light fixture comprising:

an outer housing adapted to be fixedly mounted in a hole in a wall or ceiling and centered on an axis;

an inner lamp holder provided with a socket for a light bulb and centered on an axis; and means including a pair of two stiff links of different lengths each having an inner end pivoted on the housing and an outer end pivoted on the holder for movement of the holder between an inner position recessed in the housing with the holder and housing axes generally coaxial and an outer position outside the housing with the axes inclined to each other and through intermediate positions such that as the holder moves outward the angle its axis forms with the housing axis increases and as it moves inward the angle its axis forms with the housing axis decreases, each intermediate position corresponding to a particular angular orientation of the holder axis to the housing axis.

2. The recessed light fixture defined in claim 1 wherein the holder and housing are generally symmetrical to a symmetry plane including the axes in the inner position, the means including two such pairs of links symmetrically flanking the plane.

3. The recessed light fixture defined in claim 1 wherein the links are pivoted on the holder at locations spaced apart by a predetermined small distance and on the housing at locations spaced apart by a larger distance.

4. The recessed light fixture defined in claim 1 wherein one of the links is an L-shaped long link and the other link is a short link.

5. The recessed light fixture defined in claim 1 wherein the housing includes a cylindrical outer part centered on the housing axis and a cylindrical inner part pivotal about the housing axis inside the outer part, the links being pivoted on the inner part.

6. The recessed light fixture defined in claim 5 wherein one of the parts has an annular groove centered on the axis and the other part has a ridge fitting radially into the groove.

7. The recessed light fixture defined in claim 1 wherein the holder is cup-shaped and is provided internally with a reflector.

8. The recessed light fixture defined in claim 1, further comprising a stop in the housing solidly engaging the holder only in the inner position thereof.

9. A recessed light fixture comprising:

an outer housing adapted to be fixedly mounted in a hole in a wall or ceiling, centered on an axis, and provided with a pair of spaced housing pivots;

an inner lamp holder provided with a socket for a light bulb, centered on an axis, and provided with a pair of spaced holder pivots;

a long stiff link having an inner end pivoted on the housing at one of the housing pivots and an outer end pivoted on the holder at one of the holder pivots; and a short stiff link having an inner end pivoted on the housing at the other of the housing pivots and an outer end pivoted on the holder at the other of the holder pivots, the holder being movable between an inner position recessed in the housing with the holder and housing axes generally coaxial and an outer position outside the housing with the axes inclined to each other and through intermediate positions such that as the holder moves outward the angle its axis forms with the housing axis increases and as it moves inward the angle its axis forms with the housing axis decreases, each intermediate position corresponding to a particular angular orientation of the holder axis to the housing axis.

* * * * *